US007784124B2

(12) United States Patent
Long et al.

(10) Patent No.: US 7,784,124 B2
(45) Date of Patent: Aug. 31, 2010

(54) SYSTEM AND METHOD TO OCCLUDE PATIENT ENTRAPMENT ZONES

(75) Inventors: Justin Long, San Antonio, TX (US); John Hanke, Schertz, TX (US); John Vrzalik, San Antonio, TX (US)

(73) Assignee: KCI Licensing, Inc., San Antonio, TX (US)

( * ) Notice: Subject to any disclaimer, the term of this patent is extended or adjusted under 35 U.S.C. 154(b) by 237 days.

(21) Appl. No.: 11/953,410

(22) Filed: Dec. 10, 2007

(65) Prior Publication Data

US 2009/0144908 A1 Jun. 11, 2009

(51) Int. Cl.
*A47C 27/08* (2006.01)

(52) U.S. Cl. ..... 5/424; 5/706; 5/425

(58) Field of Classification Search ..... 5/706, 5/425, 424, 715

See application file for complete search history.

(56) References Cited

U.S. PATENT DOCUMENTS

| | | | | |
|---|---|---|---|---|
| 6,163,908 | A * | 12/2000 | Vrzalik | 5/710 |
| 6,243,894 | B1 | 6/2001 | Kosumsuppamala et al. | |
| 6,427,264 | B1 | 8/2002 | Metz et al. | |
| 6,615,426 | B1 | 9/2003 | Risk, Jr. | 5/425 |
| 6,629,326 | B2 | 10/2003 | Rabe | |
| 6,668,399 | B2 | 12/2003 | Malstaff et al. | |
| 6,704,954 | B2 | 3/2004 | Metz et al. | |
| 6,721,974 | B1 | 4/2004 | Wilkinson | 5/425 |
| 6,820,293 | B2 | 11/2004 | Alverson | |
| 6,928,673 | B2 | 8/2005 | Risk, Jr. | |
| 7,007,330 | B2 | 3/2006 | Kuiper et al. | 7/715 |
| 7,107,636 | B2 | 9/2006 | Metz et al. | |
| 7,127,755 | B1 | 10/2006 | Stacy et al. | |
| 7,228,579 | B2 | 6/2007 | Tidwell | 5/624 |
| 7,246,388 | B2 | 7/2007 | DiLiberto, Jr. | 5/425 |
| 7,291,404 | B2 | 1/2009 | Parker | 5/663 |
| 2005/0125905 | A1 | 6/2005 | Wilkinson | 5/713 |

OTHER PUBLICATIONS

FDA, Center for Devices and Radiological Health, "Hospital Bed System Dimensional and Assessment Guidance to Reduce Entrapment," Mar. 10, 2006, p. 12 (www.fda.gov/cdrh/beds/guidance/1537.html).

International Search Report and Written Opinion, issued in International Patent Application No. PCT/US2008/085172, dated Feb. 4, 2009.

* cited by examiner

*Primary Examiner*—Robert G Santos
*Assistant Examiner*—Brittany M Wilson

(57) ABSTRACT

A system and method for occluding potential entrapment zones in a bed. The system may include a head-end assembly with a head-end cover enclosing a head-end pad, and a foot-end assembly with covers enclosing pads. The system may further include a pair of walls extending between the head-end assembly and the foot-end assembly. The walls may include inflatable members.

2 Claims, 5 Drawing Sheets

SYSTEM AND METHOD TO OCCLUDE PATIENT ENTRAPMENT ZONES

BACKGROUND INFORMATION

Typical medical support surfaces such as hospital beds comprise a frame, mattress, head board, foot board, and side rails. In certain examples, gaps may exist between the mattress and adjacent components such as the side rails, head board or foot board. In addition, gaps may exist between the side rails, or within the supports that couple the side rails to the frame. The Federal Drug Administration has identified specific zones between components of beds that pose specific risks to patients. See "Hospital Bed System Dimensional and Assessment Guidance to Reduce Entrapment—Guidance for Industry and FDA Staff" issued on Mar. 10, 2006, incorporated herein by reference in its entirety.

These gaps can pose a risk to a patient supported by the bed because the patient can become entrapped in the gaps. It is therefore desirable to provide a method and system of occluding the gaps from the patient to reduce the likelihood that the patient will become entrapped. However, it is also desirable to provide access for the caregiver to the patient, in case the caregiver needs to assist the patient. Furthermore, it is desirable to allow the patient to enter or exit the bed when desired. Therefore, it is desirable that a method and system of occluding the gaps not restrict access to the patient.

SUMMARY

Exemplary embodiments comprise a system and method for occluding potential entrapment zones in a bed. The system may include a head-end assembly with a head-end cover enclosing a head-end pad, and a foot-end assembly with covers enclosing pads. The system may further include a pair of walls extending between the head-end assembly and the foot-end assembly, and the walls may include inflatable members.

Exemplary embodiments comprise a pad system comprising: a head-end assembly; a foot-end assembly; and a pair of walls extending between the head-end assembly and the foot-end assembly, wherein each of the walls comprises a plurality of inflatable members. The head-end assembly may comprise a head-end cover enclosing a head-end pad and the foot-end assembly may comprise a foot-end cover enclosing a foot-end pad. Each of the walls may comprise a webbing between a first inflatable member and a second inflatable member and/or a base sheet coupled to the pair of walls. In certain exemplary embodiments, the base sheet may comprises a plurality of apertures, and at least one of the plurality of inflatable members may extend away from the base sheet.

In certain exemplary embodiments, the pair of walls are configured to allow articulation of the head-end assembly with respect to the foot-end assembly. In specific exemplary embodiments: each of the pair of walls comprises an upper portion, a middle portion and a lower portion; the upper portion, the middle portion, and the lower portion each comprise an inflatable member; and the inflatable member of the middle portion is longer than the inflatable member of the upper portion or the lower portion. In certain exemplary embodiments, an inflatable member in the middle portion may be deflated while an inflatable member in the upper portion or the lower portion remains inflated. Certain exemplary embodiments may comprise a conduit coupling the plurality of inflatable members together so that they are in fluid communication with each other Other exemplary embodiments comprise a method of occluding potential entrapment zones in a hospital bed having a frame, a mattress, a pair of side rails, a head board, and a footboard. Specific exemplary embodiments include providing a pad system comprising: a head-end assembly comprising a head-end cover enclosing a head-end pad; a foot-end assembly comprising a foot-end cover enclosing a foot-end pad, and first and second walls extending between the head-end assembly and the foot-end assembly. In specific exemplary embodiments, the walls comprise a plurality of inflatable members; and the pad system is fitted to the hospital bed.

In certain exemplary embodiments, the head-end pad is placed between the mattress and the head board, the first wall is placed between the mattress and a first side rail, the second wall is placed between the mattress and the second side rail, and the foot-end pad is placed between the mattress and the foot board. In certain exemplary embodiments, the pad system is configured to permit articulating the head-end assembly so that the head-end assembly is raised with respect to the foot-end assembly. In other exemplary embodiments, the pad system is configured to permit articulation of the mattress near an area used to support a patient's knees. In still other embodiments, each of the first and second walls comprises a middle portion having a first and second inflatable member and the first inflatable member is angled with respect to the second inflatable member after articulating the head-end assembly. In specific exemplary embodiments, the first and second walls are coupled to a base sheet, and the ends of the inflatable members that are distal from the base sheet are closer to each other than the ends of the inflatable members that are proximal to the base sheet after articulating the head-end assembly.

Still other embodiments comprise a bed comprising: a frame; a head board; a foot board; and a mattress comprising a head-end, a foot-end, a first side and a second side. Certain exemplary embodiments comprise a plurality of side rails coupled to the frame and proximal to the first side and the second side of the mattress. Specific exemplary embodiments comprise a pad system comprising: a head-end assembly; a foot-end assembly; and a pair of walls extending between the head-end assembly and the foot-end assembly, wherein each of the walls comprises a plurality of inflatable members. In specific exemplary embodiments, the head-end assembly is placed between the mattress and the head board; a first wall is placed between the mattress and a first side rail; a second wall is placed between the mattress and the second side rail, and the foot-end assembly is placed between the mattress and the foot board. In certain exemplary embodiments, the head-end assembly comprises a head-end cover enclosing a head-end pad, and the foot end assembly comprises a foot-end cover enclosing a foot-end pad. In specific exemplary embodiments, the bed is configured to articulate and the headboard can be raised with respect to the footboard.

Certain exemplary embodiments include a pad for reducing entrapment in a hospital bed having a mattress and a side rail, where the pad comprises: an upper portion comprising at least one first inflatable member; a middle portion comprising at least one second inflatable member, the second inflatable member being longer than the first inflatable member; a lower portion comprising at least one third inflatable member; and webbing connecting the upper and middle portions and the middle and lower portions to form the pad, wherein the pad is configured to fit between the mattress and the side rail.

In specific exemplary embodiments, the side rail comprises an upper rail and a lower rail with an open zone between them; and the upper portion of the pad is configured to fit between the upper rail and the mattress. In certain exemplary embodiments, the lower portion of the rail is configured to fit between the lower rail and the mattress and the middle portion at least partially extends in the open zone between the upper and lower rails.

BRIEF DESCRIPTION OF THE FIGURES

While exemplary embodiments of the present invention have been shown and described in detail below, it will be clear to the person skilled in the art that changes and modifications may be made without departing from the scope of the invention. As such, that which is set forth in the following description and accompanying drawings is offered by way of illustration only and not as a limitation. The actual scope of the invention is intended to be defined by the following claims, along with the full range of equivalents to which such claims are entitled.

In addition, one of ordinary skill in the art will appreciate upon reading and understanding this disclosure that other variations for the invention described herein can be included within the scope of the present invention. For example, different materials of construction may be used for the pads and covers employed in the pad system. Furthermore, the shape of individual pads or inflatable members may also be altered.

In the following Detailed Description of Disclosed Embodiments, various features are grouped together in several embodiments for the purpose of streamlining the disclosure. This method of disclosure is not to be interpreted as reflecting an intention that exemplary embodiments of the invention require more features than are expressly recited in each claim. Rather, as the following claims reflect, inventive subject matter lies in less than all features of a single disclosed embodiment. Thus, the following claims are hereby incorporated into the Detailed Description of Exemplary Embodiments, with each claim standing on its own as a separate embodiment.

Figure 1:
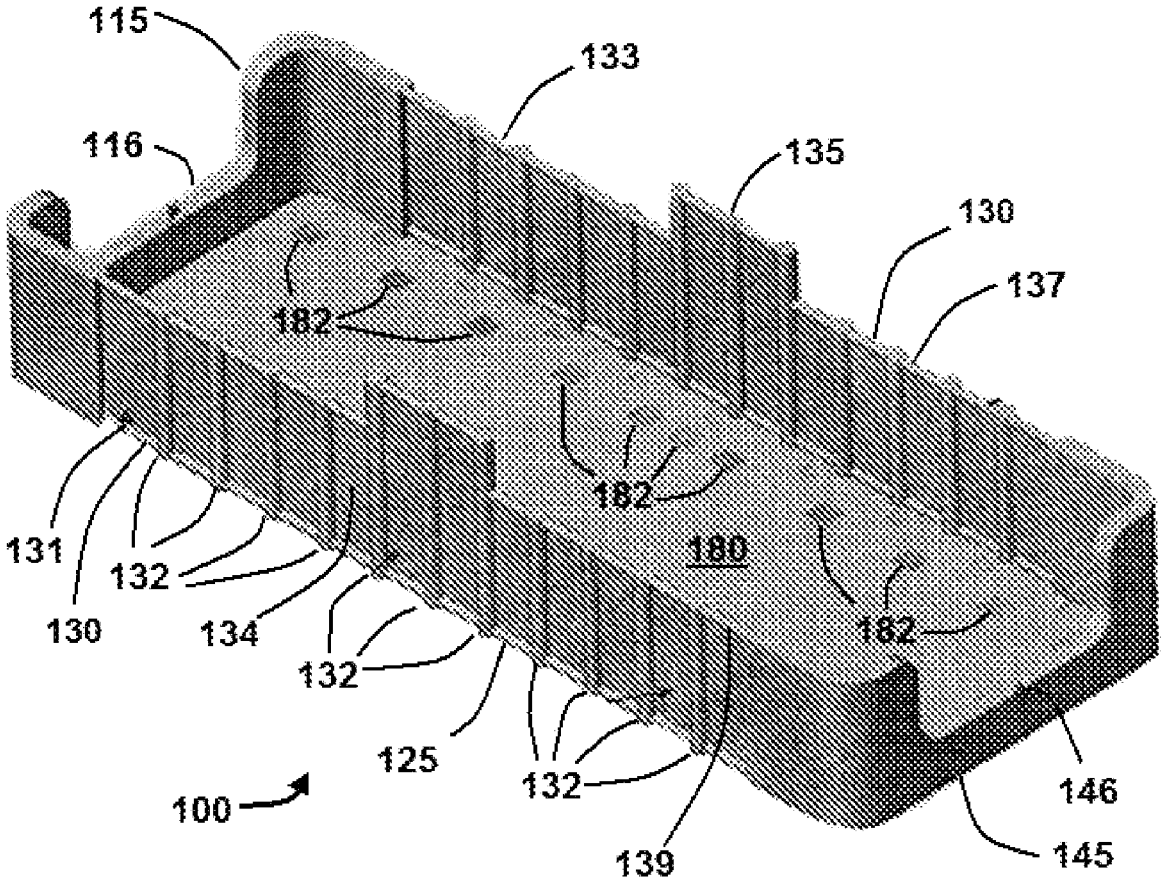

FIG. 1 is an assembly view of one non-limiting, exemplary embodiment of a pad system.

Figure 2:
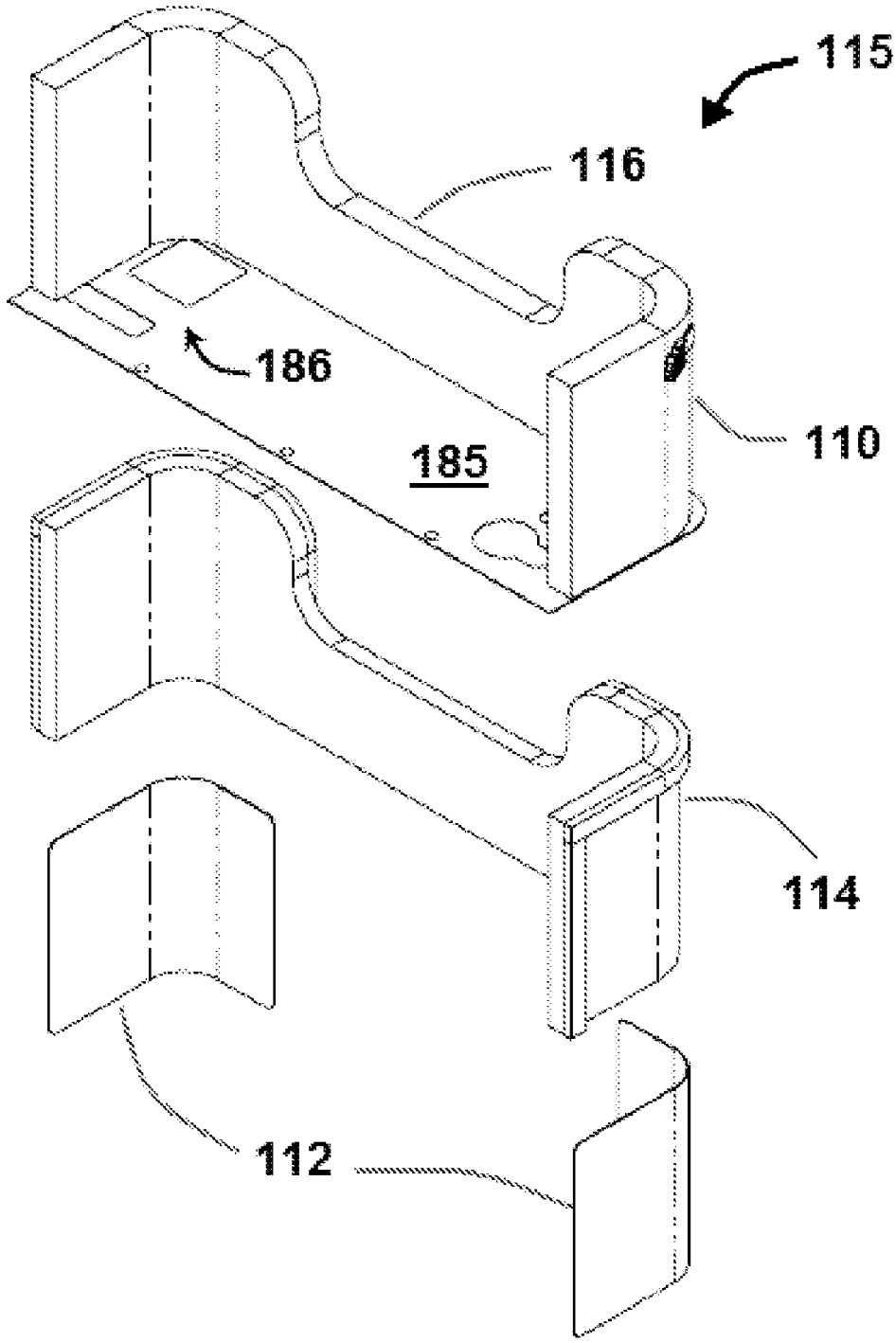

FIG. 2 is an exploded view of a portion of the embodiment of FIG. 1.

Figure 3:
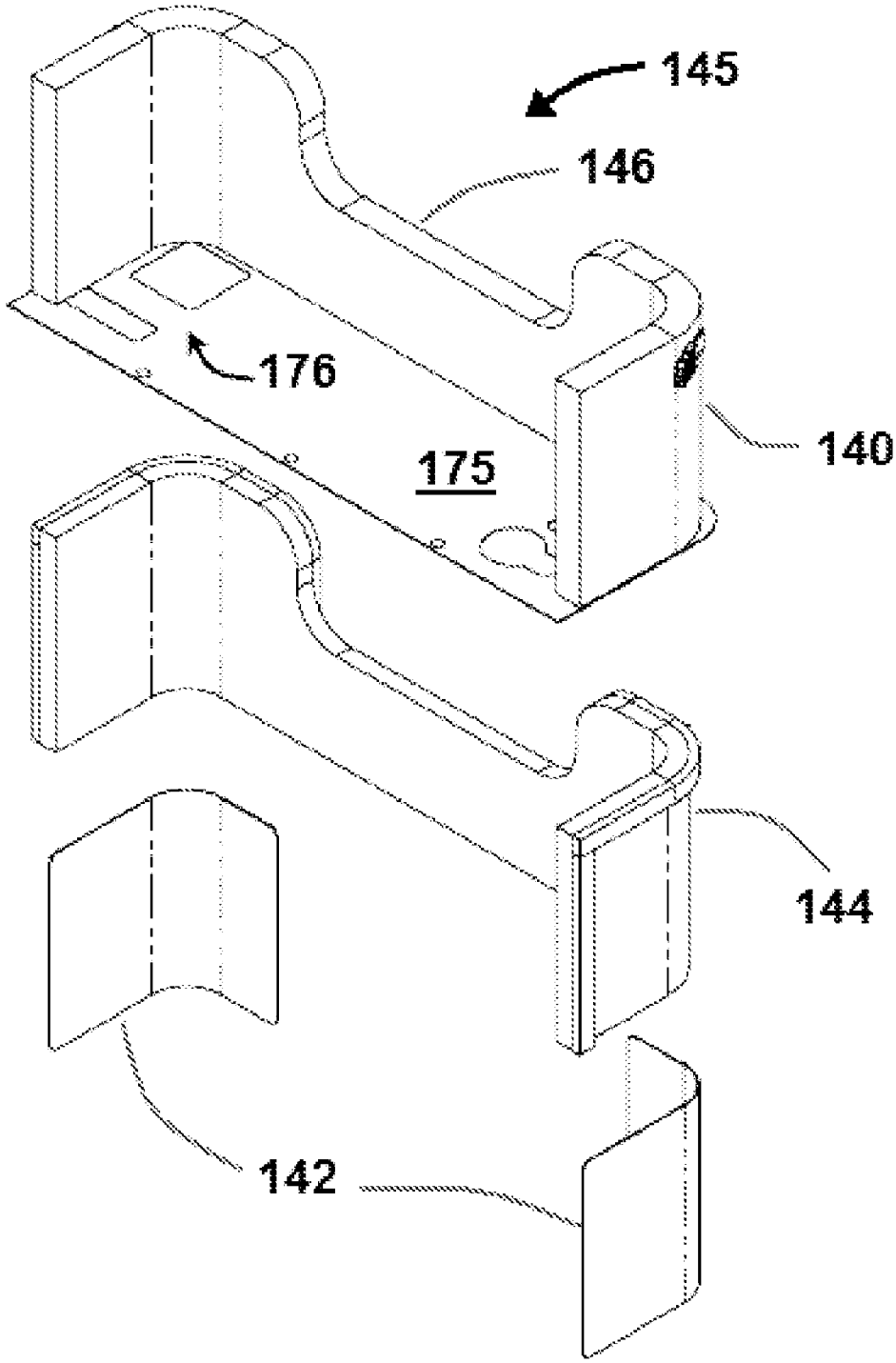

FIG. 3 is an exploded view of a portion of the embodiment of FIG. 1.

Figure 4A:
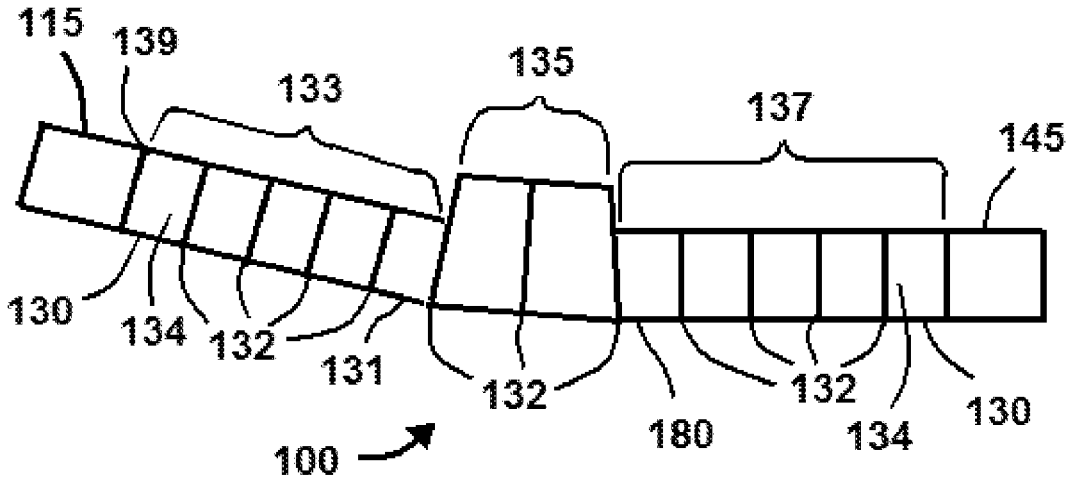

FIG. 4A is a side view of the embodiment of FIG. 1 in a first articulated position.

Figure 4B:
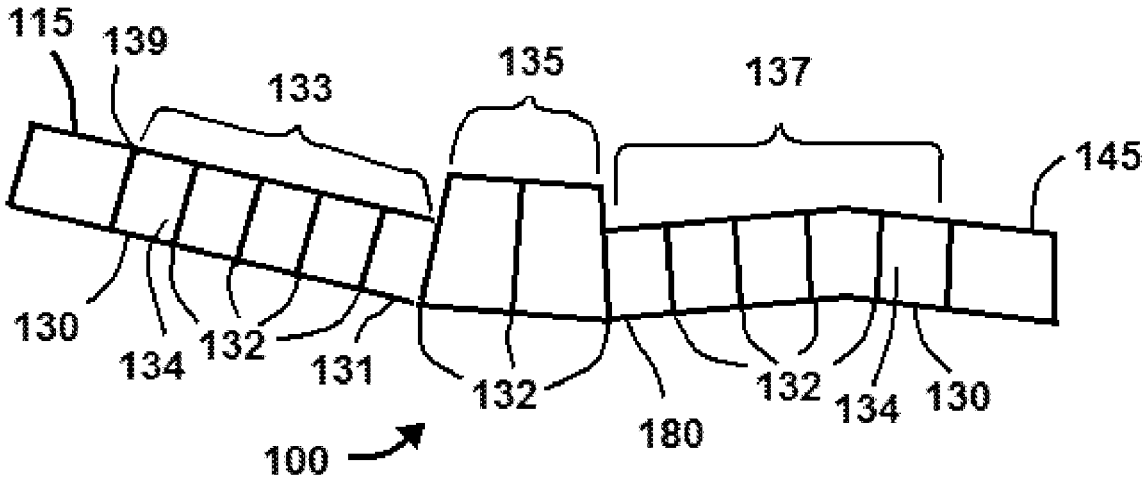

FIG. 4B is a side view of the embodiment of FIG. 1 in a second articulated position.

Figure 5:
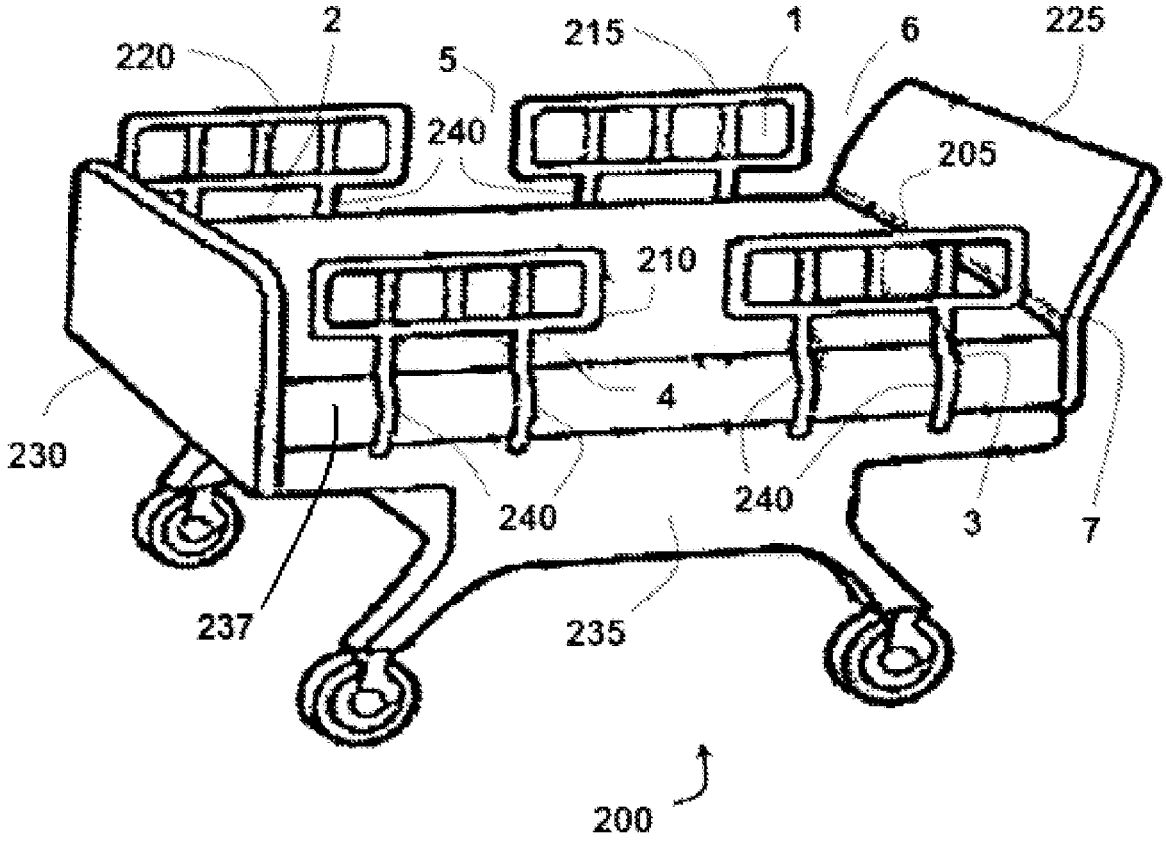

FIG. 5 is a perspective view of a bed to which the embodiment of FIG. 1 may be fitted.

DETAILED DESCRIPTION OF EXEMPLARY EMBODIMENTS

Referring now to the exemplary embodiment shown in FIGS. 1-4, a pad system 100 comprises a head-end assembly 115, a body assembly 125 and a foot-end assembly 145. Head-end assembly 115 further comprises a pair of end plates 112, a pad 114, and a cover 110. Foot-end assembly 145 similarly comprises a pair of end plates 142, a pad 144, and a cover 140. Body assembly 125 comprises a pair of walls 130 that are coupled by a base sheet 180 comprising a plurality of openings 182. Walls 130 extend between head-end assembly 115 and foot-end assembly 145. In the exemplary embodiment shown, walls 130 are mirror images of each other. For purposes of clarity, features of the pair of walls 130 may only be labeled on one wall 130. It is understood that features or elements labeled on one wall 130 may also exist on the opposing wall 130. Head-end assembly 115, body assembly 125, and foot-end assembly 145 may be coupled to each other with any form of coupling member (not shown) familiar to those skilled in the art. Non-limiting examples of coupling members include buckle and strap arrangements, hook and loop fasteners, zippers, etc. In other exemplary embodiments, head-end assembly 115 and foot-end assembly 145 may be integrally formed with body assembly 125. In still other exemplary embodiments, head-end assembly 115 and foot-end assembly 145 may comprise inflatable members similar to inflatable members 132 Such inflatable members in head-end assembly 115 and foot-end assembly 145 may be used either in lieu of or in conjunction with pads 114 and 144.

In this exemplary embodiment, each wall 130 comprises a plurality of inflatable members 132 that extend away from base sheet 180, and a webbing 134 extends between inflatable members 132. In the embodiment shown, each wall 130 comprises an upper portion 133 (proximal to head-end assembly 115), a lower portion 137 (proximal to foot-end assembly 145), and middle portion 135 between upper portion 133 and lower portion 137. As shown in FIG. 1, middle portion 135 extends above upper portion 133 and lower portion 137, so that inflatable members 132 are longer in middle portion 135 than inflatable members 132 in upper portion 133 or lower portion 137. Middle portion 135 therefore extends farther away from base sheet 180 than does upper portion 133 or lower portion 137. Inflatable members 132 may also be coupled together by a lower conduit 131 and an upper conduit 139 that allows multiple inflatable members 132 to be in fluid communication with each other. In specific exemplary embodiments, inflatable members 132 in a specific portion (for example, upper portion 133, middle portion 135 and lower portion 137) may be in fluid communication with each other, but may not be in fluid communication with inflatable members 132 in other portions.

Also shown in FIG. 1, head-end assembly 115 comprises a recess 116, while foot-end assembly 145 comprises a recess 146. Recesses 146 and 116 can allow a caregiver improved access to a patient supported in a bed that incorporates pad system 100. Such access can be important if the caregiver needs to reach the patient to perform a procedure such as CPR under emergency conditions.

In certain exemplary embodiments, pads in pad system 100 are made from an antimicrobial foam. Covers 110 and 140 can be comprised of flame resistant, polyester reinforced, anti-bacterial vinyl fabric (such as a material sold under the trade name Staph-Check). In certain exemplary embodiments, covers 110 and 140 may also comprise a coating of 0.030 inch polypropylene and/or may comprise a separate inner layer and outer layer. The inner layer may be made from a material such as those provided by Dartex®. In certain exemplary embodiments, webbing 134 may comprise an elastic material that is capable of stretching to increase its length and then returning to its original length. In specific exemplary embodiments, webbing 134 may comprise Breathoprene.

In certain exemplary embodiments, inflatable members 132 may be formed by radio frequency (RF) welding, by heat sealing, or by sewing and seam sealing. Inflatable members 132 may be constructed from a material that is capable of maintaining an internal air pressure within the inflatable member in certain exemplary embodiments. Head-end assembly 115 and foot-end assembly 145 may also be formed by RF welding, by heat sealing, or by sewing and seam sealing, in exemplary embodiments.

Referring now to the exemplary embodiment shown in FIG. 5, a bed 200 comprises a left side upper side rail 205, a left side lower side rail 210, a right side upper side rail 215 and a right side lower side rail 220. Bed 200 also comprises a head board 225 and a foot board 230 at each end of a frame 235 that supports a mattress 237. Rail supports 240 extend between each rail 205, 210, 215, 220 and frame 235. The bed 200 includes a mattress 237, which may be a conventional foam mattress or an air surface, such as those commercially available from Kinetic Concepts, Inc.

As noted in FDA guidelines "Hospital Bed System Dimensional and Assessment Guidance to Reduce Entrapment—Guidance for Industry and FDA Staff", a bed such as bed 200 comprises several potential entrapment zones in which a person supported by bed 200 could potentially become entrapped. A zone 1 exists within each of rails 205, 210, 215 and 220, while a zone 2 exists under rails 205, 210, 215, 220 (and between rail supports 240). A zone 3 exists between rails 205, 210, 215, 220 and mattress 237. A zone 4 exists at each end of rail 205, 210, 215, 220, while a zone 5 exists between rails 205 and 210, as well as between rails 215 and 220. A zone 6 exists between the ends of rails 205, 210, 215, 220 and the ends of head board 225 and foot board 230. A zone 7 exists between mattress 237 and both head board 225 and foot board 230.

In certain exemplary embodiments, pad system 100 is configured to be fitted to bed 200 in a manner that reduces the likelihood that a person could be entrapped in certain zones identified by the FDA. Specifically, pad system 100 is configured to place occlusion members in the zones and restrict access to the area or zone identified by the FDA as a potential location of entrapment. For example, inflatable members 132 of walls 130 are configured to be placed in zones 2-6 on the sides of bed 200. In addition, pads 114 and 144 are configured to be placed in zone 7 between mattress 237 and head board 225 and foot board 230. In certain exemplary embodiments with a mattress 237 that is an air support mattress, the inflatable members 132 of pad system 100 may be inflated with the same air supply used to inflate mattress 237. In other exemplary embodiments, inflatable members 132 may be inflated with a separate air supply.

As shown in the exemplary embodiment of FIG. 1, walls 130 are configured so that bed 200 can be articulated to raise the portion of bed 200 proximal to head board 225. For example, webbing 134 is flexible and allows inflatable members 132 to angle towards each other as bed 200 is articulated. As shown in FIG. 4A, in middle portion 135, the ends of inflatable members 132 that are distal from base sheet 180 may become closer to each other as upper portion 133 is raised with respect to lower portion 137. Upper conduit 139 in middle portion 135 can be compressed in length (i.e., partially collapsed into itself) so that inflatable members 132 can be angled toward each other as shown in FIG. 4A. This allows bed 200 to be positioned as desired with minimal interference from pad system 100.

In addition, lower portion 137 can be positioned to accommodate an articulation of a support surface underneath a patient's knees, as shown in FIG. 4B. In this position, upper conduit 139 and lower conduit 131 in lower portion 137 are deflected to conform to the support surface. In addition, inflatable members 132 in lower portion may be slightly angled as shown in FIG. 4B to accommodate the articulation in the support surface.

In certain exemplary embodiments, pad system 100 is configured to fit between mattress 237 and side rails 205, 210, 215, 220 to allow any of side rails 205, 210, 215, 220 to be lowered while pad system 100 is in place. The ability to lower or articulate the side rails with pad system 100 in place can further provide the caregiver with access to the patient. In certain exemplary embodiments, upper portion 133 and lower portion 137 are generally the same height as mattress 237 (before mattress 237 is deformed by the weight of a patient) to allow a patient to enter or exit bed 200. In a specific exemplary embodiment, inflatable members 132 in upper portion 133 and 137 are approximately 12 inches in length, while inflatable members 132 in middle portion 135 are approximately 16 inches in length. In addition, inflatable members 132 in middle portions 135 may be deflated (independent of or in conjunction with inflatable members 132 in upper and lower portions 133 and 137) to allow a patient to more easily enter or exit bed 200.

Cover 140 comprises a base sheet 175 extending between end plates 142, while cover 110 comprises a base sheet 185 extending between end plates 112. In certain exemplary embodiments, base sheets 175, 180 and 185 comprise a series of apertures 176, 182 and 186, respectively, which allow various connections (for example, air cushion connections) to pass through the base sheets. The apertures also facilitate attachment to the bed surface.

As previously mentioned, pad system 100 may be used in conjunction with a mattress 237 that is a conventional mattress or inflatable air mattress. In exemplary embodiments in which mattress 237 is an inflatable mattress, the inflatable portions of pad system 100 may be inflated to a pressure greater than the pressure used to inflate mattress 237. For example, inflatable members 132, upper conduit 139, and lower conduit 131 may be inflated to a pressure that is greater than mattress 237.

The invention claimed is:

1. A method of occluding potential entrapment zones in a hospital bed having a frame, a mattress, a first side rail, a second side rail, a head board, and a footboard, the method comprising:

providing a pad system comprising:

a head-end assembly comprising a head-end cover enclosing a head-end pad;

a foot-end assembly comprising a foot-end cover enclosing a foot-end pad; and first and second walls extending between the head-end assembly and the foot-end assembly, wherein each of the walls comprises a plurality of inflatable members; and fitting the pad system to the hospital bed, wherein the head-end pad is placed between the mattress and the head board, the first wall is placed between the mattress and the first side rail, the second wall is placed between the mattress and the second side rail, and the foot-end pad is placed between the mattress and the foot board; wherein:

the pad system is configured to permit articulating the head-end assembly so that the head-end assembly is raised with respect to the foot-end assembly and each of the first and second walls comprises a middle portion having a first and second inflatable member and the first inflatable member is angled with respect to the second inflatable member after articulating the head-end assembly and wherein the first and second walls are coupled to a base sheet, and wherein the ends of the inflatable members that are distal from the base sheet are closer to each other than the ends of the inflatable members that are proximal to the base sheet after articulating the head-end assembly.

2. The method of claim 1 wherein the pad system is configured to permit articulation of the mattress near an area used to support a patient's knees.

* * * * *